United States Patent [19]

Strahan

[11] 4,418,487

[45] Dec. 6, 1983

[54] MOUNTING BRACKET FOR GUNSIGHT

[76] Inventor: Travis R. Strahan, Rte. 7, Townsend Cir., Ringgold, Ga. 30736

[21] Appl. No.: 345,083

[22] Filed: Feb. 2, 1982

[51] Int. Cl.[3] ..... F41G 1/38

[52] U.S. Cl. ..... 42/1 ST

[58] Field of Search ..... 42/1 ST; 33/245

[56] References Cited

U.S. PATENT DOCUMENTS 3,834,052 9/1974 Steck ..... 42/1 ST 4,044,486 8/1977 Van Holten ..... 42/1 ST

OTHER PUBLICATIONS

Krentz, William F.; "Scope Your Handgun for Higher Scores"; *American Rifleman,* Jun. 1974, pp. 34, 35.

*Primary Examiner*—Charles T. Jordan

*Attorney, Agent, or Firm*—Alan Ruderman

[57] ABSTRACT

A gunsight mount for mounting a scope-type sight to an automatic handgun, such as a .45 automatic, has a housing including a channel for receiving the barrel and slide of the gun. The housing has an opening at the bottom, at the end most adjacent to the handle of the gun, for providing a clearance for the trigger guard. A protuberance is disposed at the bottom adjacent the slot and includes an adjustable stop member. The housing is supported on a mounting pin passing through the sides of the housing and through the slide stop pin bore of the gun. An elevational adjustment screw extends into the channel from the bottom of the housing for rigidly securing the mount to the gun while providing elevational adjustability. The scope-type sight may be fastened to the top of the housing.

8 Claims, 3 Drawing Figures

MOUNTING BRACKET FOR GUNSIGHT

BACKGROUND OF THE INVENTION

This invention relates to handgun target sight mounts and more particularly to a mounting bracket for attaching a sight or scope onto an automatic handgun.

Recent developments in handgun sights and scopes have resulted in handguns being fitted with something other than the metallic factory sights for competition shooting. One such sight, an electronic sight, illustrated in U.S. Pat. No. 3,942,901, is becoming very popular. However when mounted on an automatic weapon, such as a .45 automatic, certain problems are encountered with the known prior art mounts. For example, there are grip mounts for attaching the sight to the handle grip. However, such mounts drastically change the balance of the gun since the sights are relatively heavy in comparison to the weight of the weapon. Another known mount attaches the sight directly onto the top of the slide of the automatic weapon and thus moves with the slide as each shell is ejected. The weight of the sight and the mount moving with the slide, however, creates excessive wear on the slide and can result in rapid deterioration of the equipment.

SUMMARY OF THE INVENTION

The present invention provides a simple, inexpensive mount for handguns for attaching a scope-type sight onto the frame of the handgun. It is particularly useful for automatic handguns since it does not effect substantial changes in the balance of the gun and, since it does not mount onto or interfere with the operation of the slide, it does not cause any deterioration of the weapon or the sight.

Consequentially, it is a primary object of the present invention to provide a gunsight mount for attaching a scope-type sight onto a handgun.

It is another object of the present invention to provide a gunsight mount for attaching a scope-type sight to an automatic type handgun that is neither carried by the handle grip nor the slide.

It is a further object of the present invention to provide a gunsight mount in the form of a housing that jackets the barrel and slide of an automatic type handgun for supporting a scope-type sight on the gun.

The gunsight mount of the present invention provides a housing that jackets the barrel and slide of the gun which is received within the body of the housing. The housing is pivotably supported on a mounting pin located in the bore of the conventional slide stop pin of the gun and secured against rotation by a stop acting against the trigger guard. The mount includes an elevational adjustment feature which acts as a second stop for securing the mount rigidly to the gun.

More specifically the housing may be a substantially rectangular body member having a through channel for receiving the barrel and slide and a portion of the frame of the gun. On the forward end of the housing, i.e. the end closer to the handle grip, the body member has a slot or opening at the bottom to provide clearance for the trigger guard which extends below the bottom and the slot. The top of the housing supports the sight or scope which is secured thereto.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
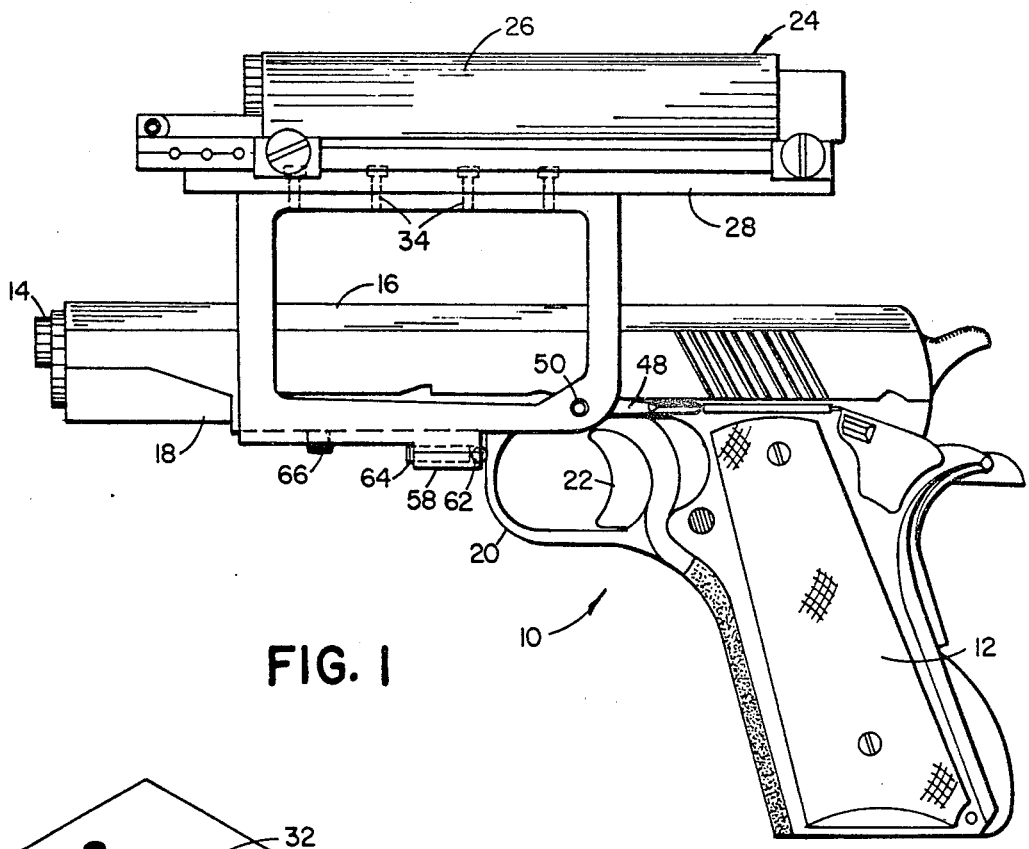
FIG. 1 is a side elevational view illustrating a .45 automatic handgun on which a sight mount constructed in accordance with the present invention is attached for mounting a target scope-type sight.

Referring now to the drawings, FIG. 1 depicts a handgun such as a .45 automatic generally indicated at 10. The gun is conventional and will only be described to the extent necessary to understand the present invention. The gun includes a handle grip 12 within which an ammunition magazine is disposed, the ammunition being automatically fed to the firing chamber (not illustrated) for propulsion out the barrel 14. A slide 16 is disposed above and about the barrel and slides relatively to the frame 18 by the action of the gases within the firing chamber to open the chamber for expulsion of the spent cartridges. A trigger guard 20 is formed as part of the frame to provide a fence about the trigger 22.

Disposed above the slide 16 for sighting a target, particularly for competitive shooting matches, is a scope-type gunsight 24 such as the electronic sight illustrated in the aforesaid U.S. Pat. No. 3,942,901, to which reference may be made for a description of the sight. For present purposes, however, the sight includes a sighting scope 26 secured to a bracket 28. As aforesaid, the known prior art has mounted the sight bracket 28 directly onto the slide 16 or to a bracket secured to a handle grip 12 with the disadvantages noted above.

Figure 2:
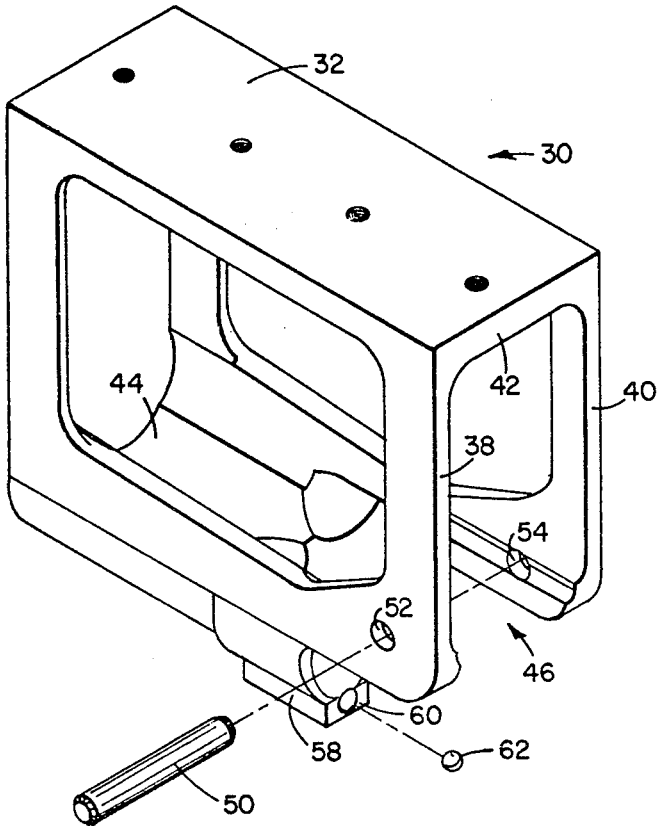
FIG. 2 is a perspective view of the sight mount depicted in FIG. 1.
Figure 3:
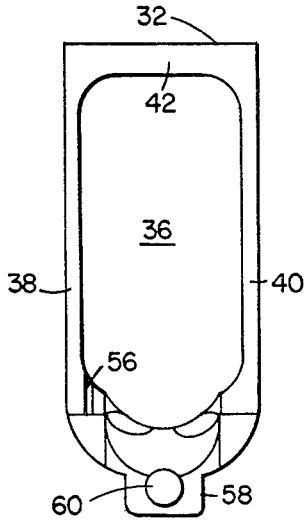
FIG. 3 is a elevational view of the sight mount as viewed from the right side of FIG. 1.

The present invention provides a mounting bracket generally designated at 30 which comprises a substantially rectangular shaped housing formed from a block of metal such as aluminum and includes a substantially planar upper surface 32 to which the bracket 28 of the sight 24 may be secured by screw means 34 or the like. An opening 36, illustrated in FIG. 3, extends entirely through the housing endwise to form a channel between the side walls 38 and 40 the top wall 42 and the bottom 44 for positioning the housing about the barrel end of the gun. At the forward end of the housing, i.e. the right side as illustrated in FIGS. 1 and 2, the bottom is cut away to form a slot 46 so that the forward end of the housing may be positioned closer to the handle grip 12 then the leading edge of the trigger guard 22. The remainder of the interior surface of the bottom 44 is arcuately contoured to conform substantially to the lower surface of the frame 18 as best illustrated in FIG. 3. Thus, the housing may be positioned against the lower surface of the gun frame and secured thereto with the forward end disposed above the opening defined by the trigger guard. As illustrated the side walls 38 and 40 have material removed therefrom to reduce the weight of the structure.

The handgun 10 includes a slide stop 48 which limits the travel of the slide 16 as is conventional in automatic weapons. Generally, the slide stop includes an integral pin so that the slide stop can be pivoted to lock the slide in the position with the firing chamber open, the slide stop pin extending through a bore in the frame above the trigger opening. The present invention utilizes the slide stop pin bore and an axially elongated pin 50 is substituted for the slide stop pin for mounting the mounting bracket housing to the gun. Thus, a bore 52, 54 is reamed through each respective side wall 38, 40 and the pin 50 is inserted through the bore 52, through the slide stop pin bore, and through the bore 54. In those guns in which the slide stop pin is integral with the slide stop, the slide stop pin is cut off and a bore is reamed in that location so that the same pin 50 that mounts the mounting bracket housing also mounts the slide stop which is disposed adjacent to the internal surface of the side wall 38, a recess 56 being provided therein to allow clearance for a portion of the slide stop.

Extending from the bottom 44 of the housing adjacent to the end of the slot 46 is a protuberance 58 having a tapped hole 60 extending lengthwise therethrough in the endwise direction. A ball 62 is disposed in the forward end of the hole 60 and a set screw 64 is threaded into the other end to force the ball against the trigger guard. This tends to rotate the mounting housing in a clockwise direction, as viewed in FIG. 1, about the pin 50 and such rotation may occur until the bottom 44 of the housing engages the lower surface of the frame 18 of the gun. However, it is preferred to tap a hole and thread a set screw 66 into the bottom of the bracket housing and into the arcuate interior surface of the bottom, so that the set screw 66 acts as a stop. Thus, by adjusting the set screw 66 prior to tightening the set screw 64 an elevational adjustment for the sight mount and sight is provided.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A mounting bracket for mounting a scope-type sight on a handgun, said handgun having a frame, a barrel supported on the frame, a handle disposed angularly relative to the barrel remote from the discharge end of the barrel, said frame including a trigger guard disposed about a trigger spaced below the barrel adjacent the handle, said bracket comprising a substantially rectangular housing having a channel extending longitudinally therethrough from a first end to a second end to define a spaced pair of side walls, a top wall and a bottom wall, said channel being of a size for receiving at least the barrel and a portion of the frame, said top wall including a planar exterior surface for supporting said sight, said bottom wall extending from the first end of the housing and having a terminus spaced from the second end, said bottom wall including an interior surface having a shape conforming substantially to that of said frame adjacent the trigger guard, each side wall having a bore intermediate said terminus and said second end, the bore in one side wall being aligned with the bore in the other side wall for receiving a pin extending from one bore to the other, a protuberance disposed on the exterior surface of said bottom wall and having a terminal surface substantially at said terminus, and adjustable stop means carried by said protuberance for extension from said terminal surface, whereby said mounting bracket may be supported on the frame by positioning said pin through said frame and securing said stop means against said trigger guard.

2. A mounting bracket as recited in claim 1, wherein said adjustable stop means comprises a threaded bore extending longitudinally therethrough, an abuttment member disposed in said threaded bore and adapted to extend from said terminal surface, and screw means threaded into said bore from the end opposite said terminal surface for moving said abuttment member beyond said terminal surface.

3. A mounting bracket as recited in claim 1, including second adjustable stop means in said bottom wall for extending from said interior surface into the channel for providing elevational adjustment of said bracket relatively to said barrel.

4. A mounting bracket as recited in claim 2, including second adjustable stop means in said bottom wall for extending from said interior surface into the channel for providing elevational adjustment of said bracket relatively to said barrel.

5. A mounting bracket as recited in claim 1, wherein said handgun is an automatic weapon including a slide and a slide stop pivotably carried by a slide stop pin, said gun further including a bore in said frame for receiving said slide stop pin, the bore in each of said side walls and the protuberance being disposed such that when the bores of the side walls are aligned with the slide stop pin bore, the terminal surface of the protuberance is adjacent the trigger guard.

6. A mounting bracket as recited in claim 5, including a recess in one side wall for providing clearance for a portion of said slide stop.

7. A mounting bracket as recited in claim 5, wherein said adjustable stop means comprises a threaded bore extending longitudinally therethrough, an abuttment member disclosed in said threaded bore and adapted to extend from said terminal surface, and screw means threaded into said bore from the end opposite said terminal surface for moving said abuttment member beyond said terminal surface.

8. A mounting bracket as recited in claim 7, including second adjustable stop means in said bottom wall for extending from said interior surface into the channel for providing elevational adjustment of said bracket relatively to said barrel.

* * * * *